US009449723B2

(12) United States Patent
Park et al.

(10) Patent No.: US 9,449,723 B2
(45) Date of Patent: Sep. 20, 2016

(54) NANOSTRUCTURE NEUTRON CONVERTER LAYER DEVELOPMENT

(71) Applicant: The United States of America as represented by the Administrator of the National Aeronautics and Space Administration, Washington, DC (US)

(72) Inventors: Cheol Park, Yorktown, VA (US); Godfrey Sauti, Hampton, VA (US); Jin Ho Kang, Newport News, VA (US); Sharon E. Lowther, Hampton, VA (US); Sheila A. Thibeault, Hampton, VA (US); Robert G. Bryant, Williamsburg, VA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 20 days.

(21) Appl. No.: 14/202,289

(22) Filed: Mar. 10, 2014

(65) Prior Publication Data

US 2014/0265057 A1 Sep. 18, 2014

Related U.S. Application Data

(60) Provisional application No. 61/777,480, filed on Mar. 12, 2013.

(51) Int. Cl.

| | |
|---|---|
| ***G21F 1/00*** | (2006.01) |
| ***G21F 1/10*** | (2006.01) |
| ***G21F 1/02*** | (2006.01) |
| *G21F 1/08* | (2006.01) |
| *G21F 3/00* | (2006.01) |

(52) U.S. Cl.
CPC ..... *G21F 1/10* (2013.01); *G21F 1/026* (2013.01); *G21F 1/08* (2013.01); *G21F 3/00* (2013.01)

(58) Field of Classification Search
None
See application file for complete search history.

(56) References Cited

FOREIGN PATENT DOCUMENTS

WO 2009105085 A1 8/2009

OTHER PUBLICATIONS

M. W. Smith, K. C. Jordan. C. Park, J.-W. Kim, P. T. Lillehei, R. Crooks, J. S. Harrison, "Very Long Single and Few walled Boron Nitride Nanotubes via the Pressurized Vapor/Condenser Method," Nanotechnology, 2009, vol. 20, p. 505604.

(Continued)

*Primary Examiner* — Monica Huson
(74) *Attorney, Agent, or Firm* — Jennifer L. Riley

(57) ABSTRACT

Methods for making a neutron converter layer are provided. The various embodiment methods enable the formation of a single layer neutron converter material. The single layer neutron converter material formed according to the various embodiments may have a high neutron absorption cross section, tailored resistivity providing a good electric field penetration with submicron particles, and a high secondary electron emission coefficient. In an embodiment method a neutron converter layer may be formed by sequential supercritical fluid metallization of a porous nanostructure aerogel or polyimide film. In another embodiment method a neutron converter layer may be formed by simultaneous supercritical fluid metallization of a porous nanostructure aerogel or polyimide film. In a further embodiment method a neutron converter layer may be formed by in-situ metalized aerogel nanostructure development.

12 Claims, 6 Drawing Sheets

(56) References Cited

OTHER PUBLICATIONS

C. Park, Z. Ounaies, K. Watson, R. Crooks, J. Smith, J. Connell, S. E. Lowther, J. Siochi, J. S. Harrison T. L. St. Clair, "Dispersion of Single Wall Carbon Nanotubes by In Situ Polymerization Under Sonication" Chem. Phys. Lett., 2002, vol. 364. pp. 303-308.

Z. Ounaies, C. Park, K. E. Wise, E. J. Siochi, and J. S. Harrison, "Electrical properties of single wall carbon nanotube reinforced polymide composites," Comp. Sci Tech., 2003, vol. 63, pp. 1637-1646.

D. S. McLachlan, C. Chiteme, C. Park, K. E. Wise, S. E. Lowther, P. T. Lillehei, E. J. Siochi, and J. S. Harrison, "AC and DC percolative conductivity of single wall carbon nanotube polymer composites." J. Poly. Sci.: Poly. Phys., 2005, vol. 43, pp. 3273-3287.

C. Park, J. Wilkinson, S. Banda, Z. Ounaies, K. E. Wise, G. Sauti, P. T. Lillehei, and J. S. Harrison, "Aligned Single Wall Carbon Nanotube Polymer Composites Using an Electric Field," J. Poly. Sci.: Poly. Phys., 2006, vol. 44, pp. 1751-1762.

B. Mukherjee and P. Cross; "Analysis of neutron and gamma ray doses acculmulated during commercial Trans-Pacific flights between Australia and USA", Radiation Measurements, 2000, vol. 32, pp. 43-48.

NANOSTRUCTURE NEUTRON CONVERTER LAYER DEVELOPMENT

CROSS-REFERENCE TO RELATED PATENT APPLICATION(S)

This patent application claims the benefit of and priority to U.S. Provisional Patent Application No. 61/777,480, filed on Mar. 12, 2013, the contents of which are hereby incorporated by reference in their entirety.

STATEMENT REGARDING FEDERALLY SPONSORED RESEARCH OR DEVELOPMENT

The invention described herein was made in the performance of work under a NASA contract and by employees of the United States Government and is subject to the provisions of Public Law 96-517 (35 U.S.C. §202) and may be manufactured and used by or for the Government for governmental purposes without the payment of any royalties thereon or therefore. In accordance with 35 U.S.C. §202, the contractor elected not to retain title.

BACKGROUND OF THE INVENTION

Ionizing radiation, and in particular neutrons, pose a hazard to crew, passengers, and equipment in the aerospace and other industries. For example, research indicates that for flights within the commercial height range, aircrew and frequent flying passengers may be subject to radiation dose levels significantly above that permitted for members of the public under statutory recommendations. Equipment and crews on spacecraft that for part or all of their flight profile enter into low earth orbit, or travel beyond low earth orbit, are subjected to even higher radiation risks than aircraft at commercial height ranges.

One hazard of neutron radiation is neutron activation, i.e., the ability of neutron radiation to induce radioactivity in most substances it encounters, including a person's body tissues. The risk posed by radiation has long been recognized as one of the major challenges to frequent and long duration spaceflight.

To help address the risks posed by neutron radiation, effective neutron radiation absorbers and detectors are needed. However, materials for neutron radiation detection have rarely been studied extensively.

BRIEF SUMMARY OF THE INVENTION

The present invention provides methods for making a neutron converter layer. The various embodiment methods enable the formation of a single layer neutron converter material. The single layer neutron converter material formed according to the various embodiments may have a high neutron absorption cross-section, tailored resistivity providing a good electric field penetration with submicron particles, and a high secondary electron emission coefficient.

In an embodiment method a neutron converter layer may be formed by sequential supercritical fluid metallization of a porous nanostructure aerogel or polyimide film. In another embodiment method a neutron converter layer may be formed by simultaneous supercritical fluid metallization of a porous nanostructure aerogel or polyimide film. In a further embodiment method a neutron converter layer may be formed by in-situ metalized aerogel nanostructure development.

These and other features, advantages, and objects of the present invention will be further understood and appreciated by those skilled in the art by reference to the following specification, claims, and appended drawings.

BRIEF DESCRIPTION OF THE SEVERAL VIEWS OF THE DRAWINGS

The accompanying drawings, which are incorporated herein and constitute part of this specification, illustrate exemplary embodiments of the invention, and together with the general description given above and the detailed description given below, serve to explain the features of the invention.

DETAILED DESCRIPTION OF THE INVENTION

Figure 1:
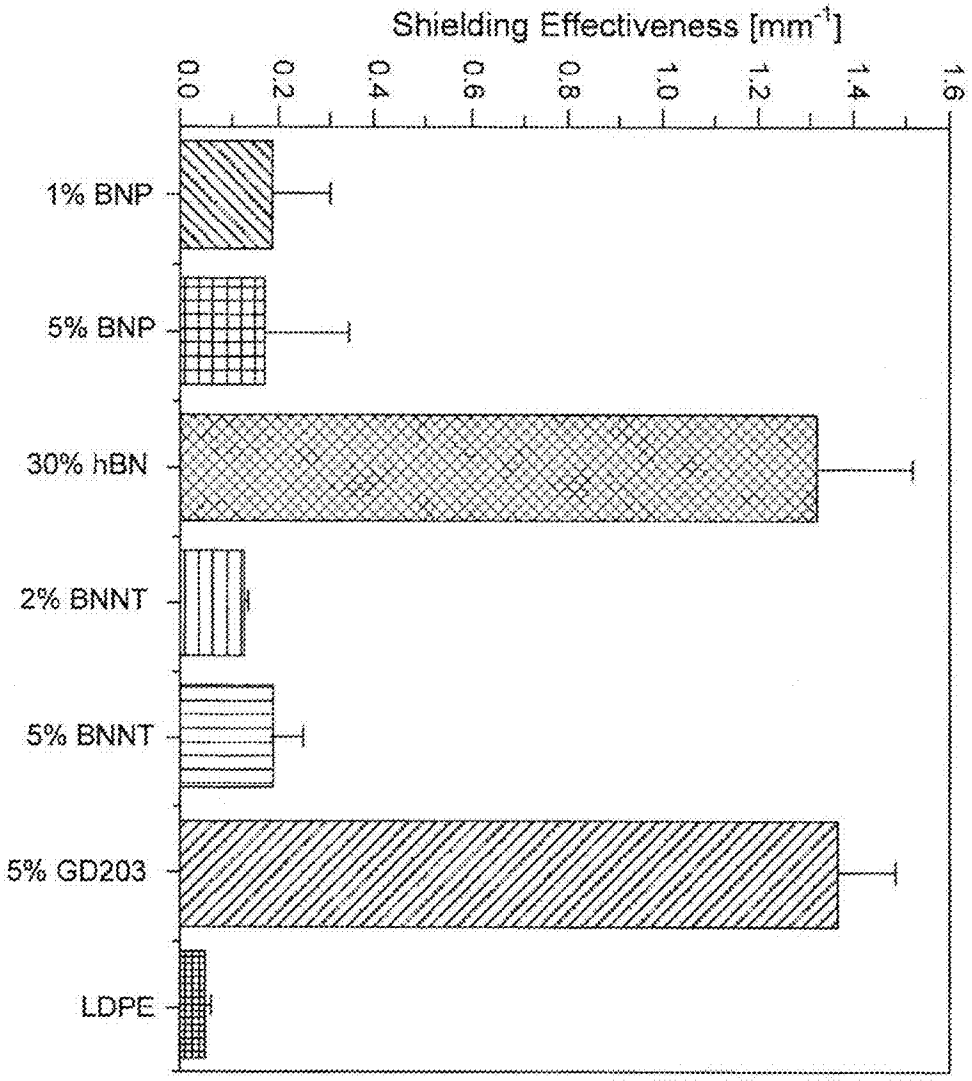
FIG. 1 is a graph of neutron shielding effectiveness for various materials.

For purposes of description herein, it is to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The word "exemplary" is used herein to mean "serving as an example, instance, or illustration." Any implementation described herein as "exemplary" is not necessarily to be construed as preferred or advantageous over other implementations.

The various embodiments will be described in detail with reference to the accompanying drawings. Wherever possible, the same reference numbers will be used throughout the drawings to refer to the same or like parts. References made to particular examples and implementations are for illustrative purposes, and are not intended to limit the scope of the invention or the claims.

As used herein "a high neutron absorption cross-section" may be a neutron absorption cross-section at or above 1.9 barns. For comparison purposes, the neutron absorption cross-sections of various materials are illustrated in Table 1.

TABLE 1

| Material | Density (g/cm$^3$) | Neutron Abs x-sections (barns) |
|---|---|---|
| Aluminum | 2.7 | 0.212 |

TABLE 1-continued

| Material | Density (g/cm$^3$) | Neutron Abs x-sections (barns) |
|---|---|---|
| Boron | BN (2.27); BNNT (1.37) | 710 ($^{10}$B: 3835) |
| Gadolinium | 79 | 49000 |
| Lead | 11.34 | 0.28 |
| Titanium | 4.54 | 5.0 |
| Nitrogen | gas | 1.9 |
| Hydrogen | gas | 0.33 |
| Carbon | 1.8-3.5 | 0.0035 |

As used herein "a high electron emission coefficient" may be a secondary electron emission coefficient ("SEE") greater than 1.

As used herein "tailored resistivity" may be resistivity greater than or equal to $10^7$ Ohms/cm and less than or equal to $10^9$ Ohms/cm.

Materials for neutron radiation detection that can provide a high neutron absorption cross-section, high electron emission coefficient, and tailored resistivity have rarely been studied. Multiple layers have been used to attempt to achieve a high neutron absorption cross-section, high electron emission coefficient, and tailored resistivity, but there are a number of disadvantages to using multiple layers, in particular, the inability to achieve a material with a high neutron absorption cross-section, high electron emission coefficient, and tailored resistivity without disrupting other functions of the material. Multiple layer material has required the use of large amounts of filler material to achieve a high neutron absorption cross-section, high electron emission coefficient, and tailored resistivity. The use of filler material has resulted in increasing the weight of the multiple layer material because fillers are generally denser than the matrix of the multiple layer material, complexity in manufacture of the multiple layer material, and cost increases for the multiple layer material as larger amounts of neutron attenuating filler material are added. Additionally, processability of the multiple layer material decreases as filler volume increases and negative impacts on other desirable properties of the multiple layer material occur as filler volume increases.

The present invention provides methods for making a neutron converter layer. The various embodiment methods enable the formation of a single layer neutron converter material. The various embodiments may enable the development of a neutron converter layer formed as a one layer porous nanostructure or a one layer solid film. The single layer neutron converter material formed according to the various embodiments may have a high neutron absorption cross-section, tailored resistivity providing a good electric field penetration with submicron particles, and a high electron emission coefficient. In some embodiments, a high neutron absorption cross-section may be achieved by the use of lithium (Li), boron (B), and/or gadolinium (Gd) as precursors. In some embodiments, a high electron emission coefficient may be achieved by the use of Magnesium Oxide (MgO) and/or Cesium Iodide (CsI) as precursors.

Neutron shielding materials for aerospace applications are being developed under the Materials International Space Station Experiments ("MISSE") program. Emerging materials such as boron nitride nanotubes ("BNNT") and single wall carbon nanotubes ("SWCNT") as well as B, hexagonal boron nitride (h-BN), and Gd nanoparticles have been studied using a neutron exposure lab with a 1 Curie (Ci) americium/beryllium source. The preliminary study indicates that BNNT, h-BN, and Gd exhibited excellent neutron radiation shielding effectiveness compared with polyethylene. Polymers containing high nitrogen (N) composition, such as polyimides, showed good neutron shielding effectiveness compared with non-nitrogen containing polymers. All N, B, and Gd possess high neutron absorption cross-sections compared with other elements and exhibited excellent neutron shielding effectiveness (i.e., above 0.1 mm$^{-1}$) as illustrated in the graph shown in FIG. 1.

Figure 2:
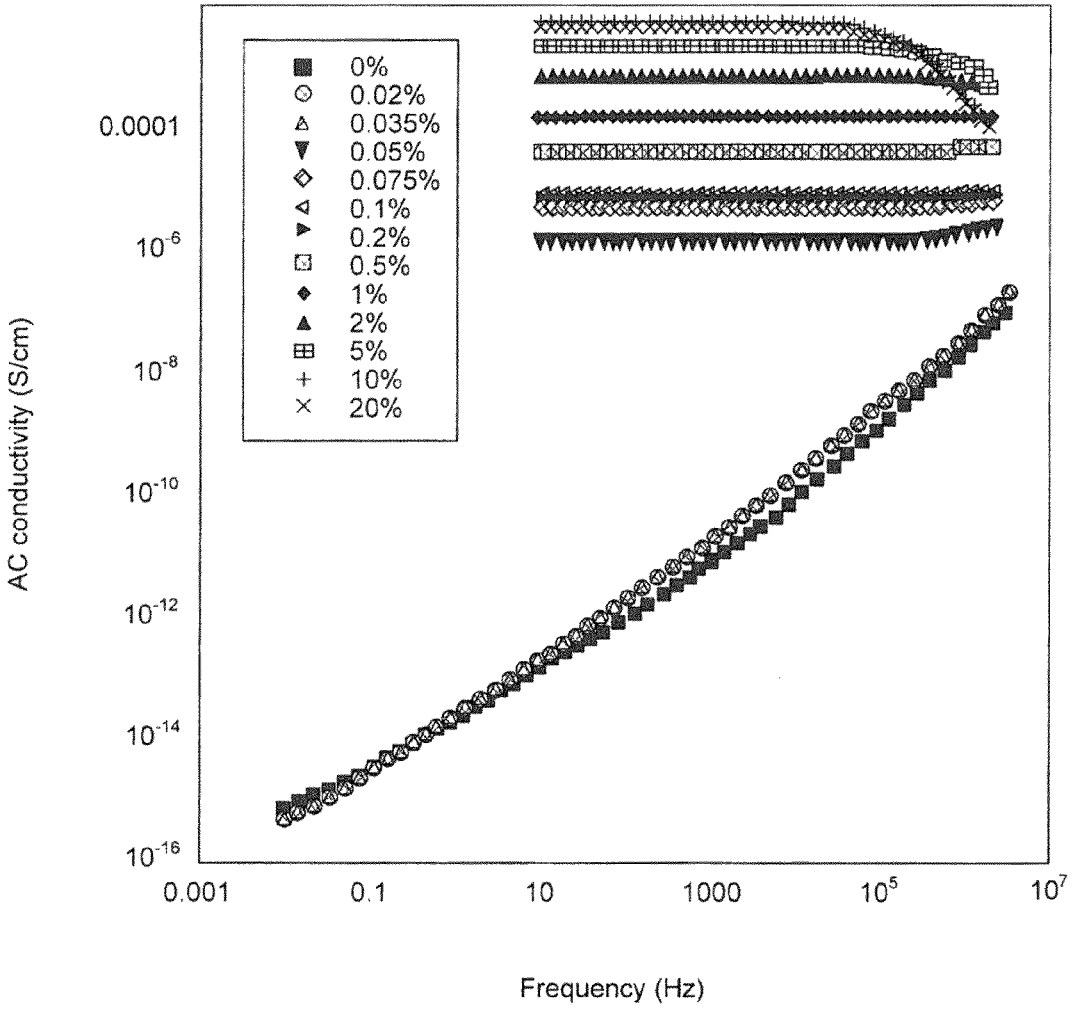
FIG. 2 is a graph of electrical conductivity over frequency for various carbon nanotube volumes.

Tailoring physical properties of nanocomposites has been the main focus of research activities, such as private industry ("PI") research activities, throughout the last decade to generate multifunctionalities for specific aerospace applications of interest. Especially for sensor and actuator applications, electrical conductivity and dielectric properties were effectively controlled as a function of the degree of dispersion, concentration, and orientation of the nanoinclusions. For example, the electrical conductivity can be controlled by several orders of magnitude with less than a 0.05% volume of carbon nanotubes as seen in FIG. 2.

Figure 3:
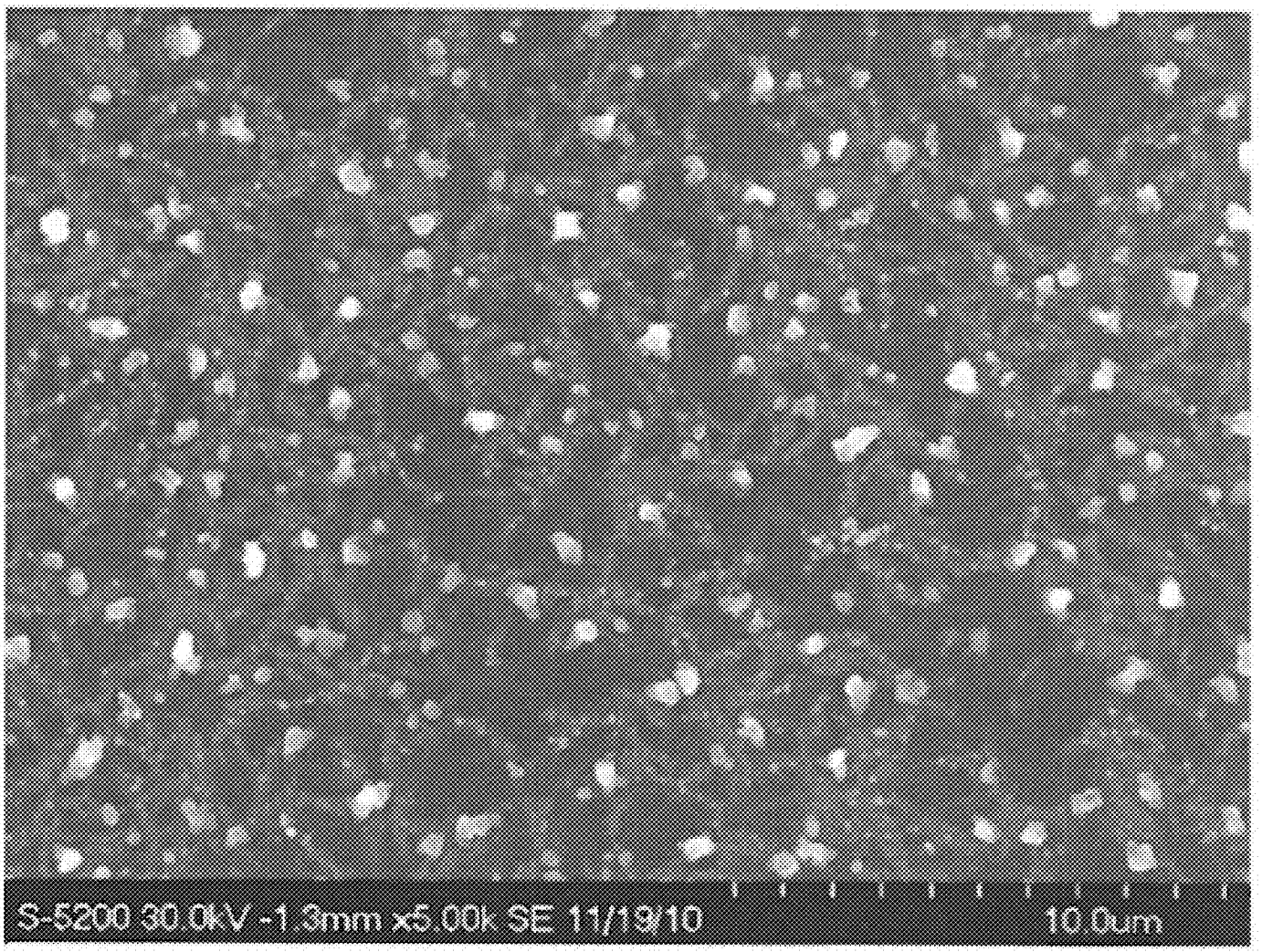
FIG. 3 is an image of a silver nanoparticle infused single wall carbon nanotubes ("SWCNT") polymer composite morphology.

Supercritical fluid ("SCF") metal infusion has been studied and a novel metallized nanotube polymer composites ("MNPC") has been developed to incorporate functional metals on the nanotube surface preferentially inside of a polymer matrix. Various metals (such as silver (Ag), gold (Au), platinum (Pt), palladium (Pd), iron (Fe), cobalt (Co), and nickel (Ni)) have been successfully metalized inside of a polymer and a SWCNT polymer composite. The metal particle size, infusion depth, and distribution may be controlled as a function of the SCF infusion conditions (e.g., time, temperature, and pressure). A silver nanoparticle infused SWCNT polymer composite morphology is shown in FIG. 3. Bright round dots represent reduced silver nanoparticles deposited on the SWCNT surface predominantly.

The following section describes embodiment methods to develop a nanostructure with high neutron absorption cross-section, high electron emission coefficient, and tailored resistivity. In the various embodiment methods a porous aerogel nanostructure (e.g. silica) with nanoparticles offering three functions may be processed systematically. Different approaches are performed to achieve the proposed nanostructure.

In an embodiment method a neutron converter layer may be formed by sequential supercritical fluid metallization of a porous nanostructure aerogel or polyimide film. In another embodiment method a neutron converter layer may be formed by simultaneous supercritical fluid metallization of a porous nanostructure aerogel or polyimide film. In a further embodiment method a neutron converter layer may be formed by in-situ metalized aerogel nanostructure development.

Figure 4:
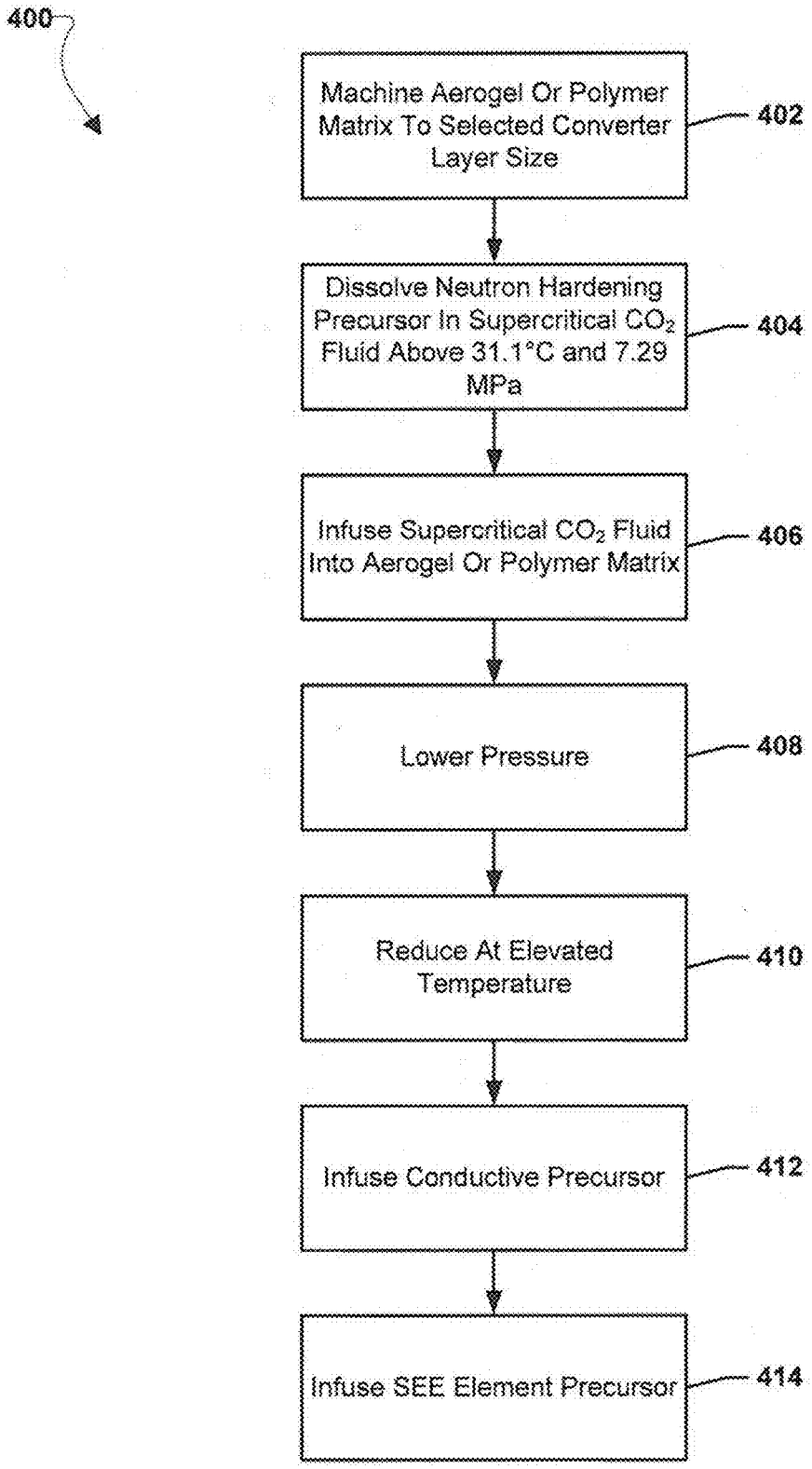
FIG. 4 is a process flow diagram illustrating an embodiment method for forming a neutron converter layer by sequential supercritical fluid metallization of a porous nanostructure aerogel or polyimide film.

FIG. 4 is a process flow diagram illustrating an embodiment method 400 for forming a neutron converter layer by sequential supercritical fluid metallization of a porous nanostructure aerogel or polyimide film. In step 402*a* nanostructured aerogel or polymer matrix (e.g., a commercially purchased nanostructured aerogel or polyimide film) may be machined to a selected (e.g., appropriate to the intended application) dimension for the converter layer. In step 404 neutron hardening precursors (e.g., B and/or Gd) may be dissolved in a supercritical carbon dioxide ($CO_2$) fluid above 31.1 degrees Celsius and 7.29 MPa (72.0 bar). In step 406 the supercritical $CO_2$ fluid with the precursors dissolved in it may be infused into the aerogel or polymer (i.e., polymide) matrix. In step 408 the pressure may be lowered, thereby trapping the infused metal precursors into the internal pores and surfaces of the aerogel or polymer matrix uniformly while the highly diffusive $CO_2$ escapes rapidly. In step 410 the trapped and deposited metal precursors may be reduced at an elevated temperature to create nanoparticles. In step 412 conductive precursors may be infused, and in step 414 high SEE element precursors (e.g., MgO and/or CsI) may be infused to provide appropriate conductivity and SEE, respectively to the neutron converter layer.

Figure 5:
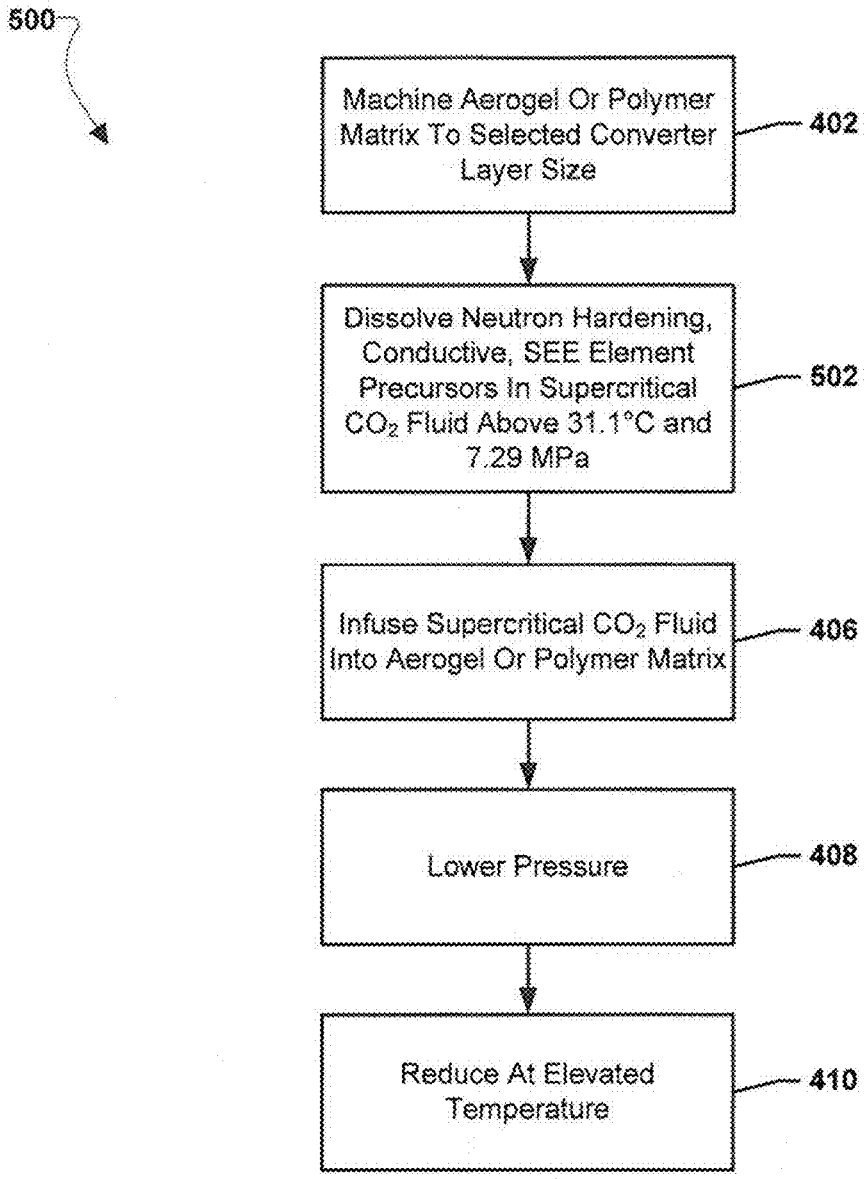
FIG. 5 is a process flow diagram illustrating an embodiment method for forming a neutron converter layer by simultaneous supercritical fluid metallization of a porous nanostructure aerogel or polyimide film.

FIG. 5 is a process flow diagram illustrating an embodiment method 500 for forming a neutron converter layer by simultaneous supercritical fluid metallization of a porous nanostructure aerogel or polyimide film. Method 500 is similar to method 400 described above with reference to FIG. 4, except that in method 500 the neutron hardening, conductive, and SEE element precursors are applied together. In step 502 neutron hardening precursors (e.g., B and/or Gd), conductive, and SEE element precursors (e.g., MgO and/or CsI) may be dissolved in a supercritical carbon dioxide ($CO_2$) fluid above 31.1 degrees Celsius and 7.29 MPa (72.0 bar). Because the neutron hardening, conductive, and SEE element precursors are applied together, steps 412 and 414 may not be required in method 500.

Figure 6:
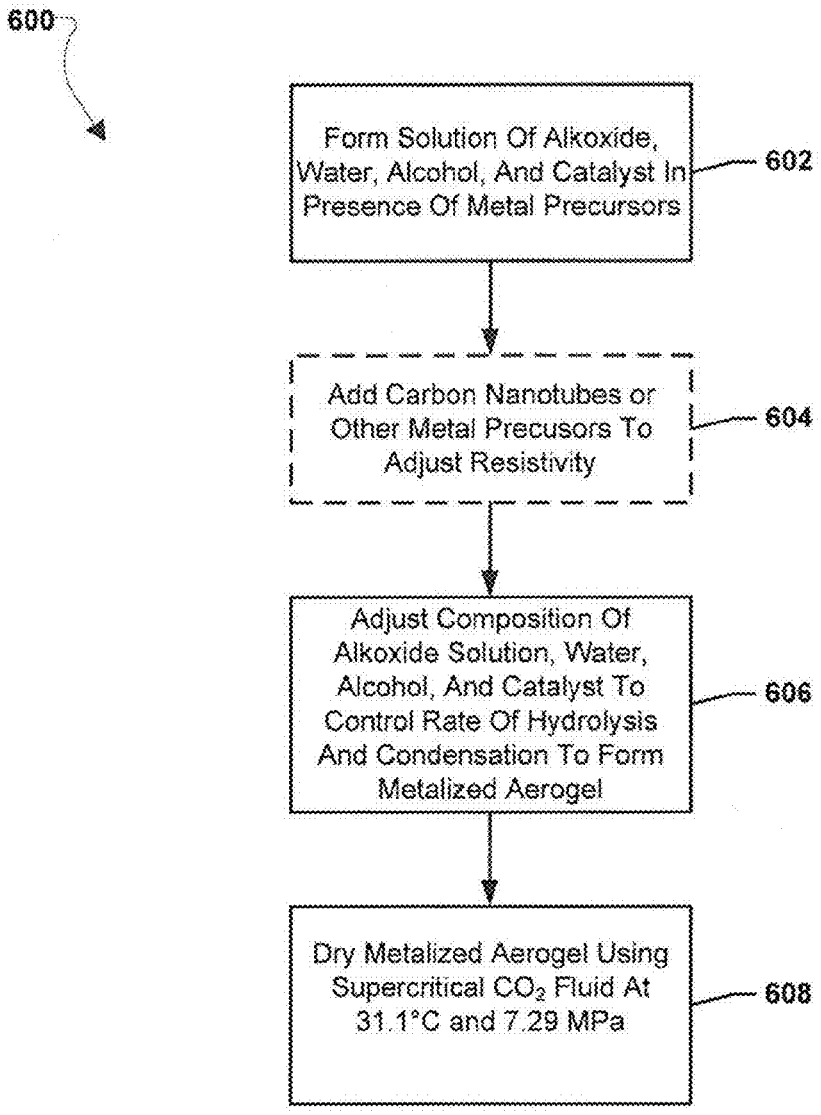
FIG. 6 is a process flow diagram illustrating an embodiment method for forming a neutron converter layer by in-situ metalized aerogel nanostructure development.

FIG. 6 is a process flow diagram illustrating an embodiment method 600 for forming a neutron converter layer by in-situ metalized aerogel nanostructure development. In method 600 the aerogel may be created via a sol-gel process in the presence of metal precursors (e.g., $Gd_2O_3$, $B_2O_3$, MgO, and/or CsI). In step 602*a* solution of alkoxide solution, water, alcohol, and basic catalyst may be formed in the presence of the metal precursors. In optional step 604 the resistivity of the metalized aerogel may be adjusted by adding a small quantity of carbon nanotubes or other metal precursors. In step 606 the composition of alkoxide solution, water, alcohol, and basic catalyst may be adjusted to control the rate of hydrolysis and condensation. The radiation hardened nanoparticles (e.g., B and/or Gd) and the high SEE nanoparticles (e.g., MgO and/or CsI) may uniformly form inside of the aerogel structure. In step 608 supercritical carbon dioxide ($CO_2$) fluid at 31.1 degrees Celsius and 7.29 MPa (72.0 bar) may employed to dry the condensed gel with the nanoparticles. Method 600 may provide uniformly distributed functional nanoparticles incorporated into an aerogel nanostructure.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

All ranges disclosed herein are inclusive of the endpoints, and the endpoints are independently combinable with each other. Each range disclosed herein constitutes a disclosure of any point or sub-range lying within the disclosed range.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." As used herein, the term "and/or" includes any and all combinations of one or more of the associated listed items. As also used herein, the term "combinations thereof" includes combinations having at least one of the associated listed items, wherein the combination can further include additional, like non-listed items. Further, the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

Reference throughout the specification to "another embodiment", "an embodiment", "some embodiments", and so forth, means that a particular element (e.g., feature, structure, and/or characteristic) described in connection with the embodiment is included in at least one embodiment described herein, and can or cannot be present in other embodiments. In addition, it is to be understood that the described elements can be combined in any suitable manner in the various embodiments and are not limited to the specific combination in which they are discussed.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

What is claimed is:

1. A method for forming a neutron converter layer, comprising:

machining an aerogel or polymer matrix to a selected converter layer size;

dissolving a neutron hardening precursor in a supercritical carbon dioxide ($CO_2$) fluid above a temperature of 31.1 degrees Celsius and a pressure of 7.29 MPa;

infusing the supercritical $CO_2$ fluid with the dissolved neutron hardening precursor into the aerogel or polymer matrix;

lowering the pressure to trap the infused neutron hardening precursor in the aerogel or polymer matrix;

reducing the aerogel or polymer matrix including the trapped infused neutron hardening precursor at an elevated temperature;

infusing a conductive precursor into the reduced aerogel or polymer matrix; and infusing a secondary electron emission coefficient (SEE) element precursor into the reduced aerogel or polymer matrix.

2. The method of claim 1, wherein the neutron hardening precursor is boron or gadolinium.

3. The method of claim 2, wherein the SEE element precursor is magnesium oxide or cesium iodide.

4. The method of claim 3, wherein the neutron converter layer has a high neutron absorption cross-section, a high electron emission coefficient, and a tailored resistivity.

5. A method for forming a neutron converter layer, comprising:

machining an aerogel or polymer matrix to a selected converter layer size;

dissolving neutron hardening precursor, a conductive precursor, and a secondary electron emission coefficient (SEE) element precursor in a supercritical carbon dioxide ($CO_2$) fluid above a temperature of 31.1 degrees Celsius and a pressure of 7.29 MPa;

infusing the supercritical $CO_2$ fluid with the dissolved neutron hardening precursor, conductive precursor, and SEE element precursor into the aerogel or polymer matrix;

lowering the pressure to trap the infused neutron hardening precursor, conductive precursor, and SEE element precursor in the aerogel or polymer matrix; and reducing the aerogel or polymer matrix including the trapped infused neutron hardening precursor, conductive precursor, and SEE element precursor at an elevated temperature.

6. The method of claim 5, wherein the neutron hardening precursor is boron or gadolinium.

7. The method of claim 6, wherein the SEE element precursor is magnesium oxide or cesium iodide.

8. The method of claim 7, wherein the neutron converter layer has a high neutron absorption cross-section, a high electron emission coefficient, and a tailored resistivity.

9. A method for forming a neutron converter layer, comprising:

forming a solution of an alkoxide solution, water, alcohol, and a basic catalyst in the presence of metal precursors;

adjusting a composition of the alkoxide solution, water, alcohol, and the basic catalyst to control a rate of hydrolysis and condensation and form a metalized aerogel having radiation hardened nanoparticles and secondary electron emission coefficient (SEE) nanoparticles; and drying the metalized aerogel having radiation hardened nanoparticles and SEE nanoparticles using a supercritical carbon dioxide ($CO_2$) fluid at a temperature of 31.1 degrees Celsius and a pressure of 7.29 MPa to form a single layer neutron converter material.

10. The method of claim 9, wherein the metal precursors are selected from the group consisting of $Gd_2O_3$, $B_2O_3$, MgO, CsI, and any combinations thereof;

wherein the radiation hardened nanoparticles include boron or gadolinium, and wherein the secondary electron emission coefficient (SEE) nanoparticles include magnesium oxide or cesium iodide.

11. The method of claim 9, further comprising adding a quantity of carbon nanotubes to adjust a resistivity of the metalized aerogel having radiation hardened nanoparticles and SEE nanoparticles.

12. The method of claim 11, wherein the neutron converter layer has a high neutron absorption cross-section, a high electron emission coefficient, and a tailored resistivity.

* * * * *